US008510968B2

(12) United States Patent
Bunnell

(10) Patent No.: US 8,510,968 B2
(45) Date of Patent: Aug. 20, 2013

(54) TURBINE AND AIR KNIFE ASSEMBLY

(76) Inventor: Michael H. Bunnell, Plymouth, MI (US)

( * ) Notice: Subject to any disclaimer, the term of this patent is extended or adjusted under 35 U.S.C. 154(b) by 262 days.

(21) Appl. No.: 13/011,439

(22) Filed: Jan. 21, 2011

(65) Prior Publication Data

US 2011/0168085 A1 Jul. 14, 2011

Related U.S. Application Data

(63) Continuation-in-part of application No. PCT/US2010/053665, filed on Oct. 22, 2010.

(60) Provisional application No. 61/254,018, filed on Oct. 22, 2009, provisional application No. 61/357,826, filed on Jun. 23, 2010.

(51) Int. Cl.
*F26B 25/06* (2006.01)

(52) U.S. Cl.
USPC ..... 34/666; 34/90; 114/274; 418/1; 165/184; 60/39.37; 415/68

(58) Field of Classification Search
USPC ..... 34/90, 104, 105, 596, 666; 418/1, 418/145; 114/274; 165/121, 184; 60/39.37, 60/796; 415/60, 68
See application file for complete search history.

(56) References Cited

U.S. PATENT DOCUMENTS 2,242,294 A * 5/1941 Rice et al. ..... 95/195
2,935,946 A * 5/1960 Gallo et al. ..... 102/374
3,258,634 A * 6/1966 Rich ..... 313/231.01
4,615,123 A * 10/1986 Brown ..... 34/577
5,090,136 A * 2/1992 Hunt et al. ..... 34/218
5,113,600 A * 5/1992 Telchuk ..... 34/90
5,205,537 A * 4/1993 Pfeiffer ..... 251/205
5,456,023 A * 10/1995 Farnan ..... 34/270
5,568,692 A * 10/1996 Crompton et al. ..... 34/270
5,921,002 A * 7/1999 Scheufler et al. ..... 34/269

(Continued)

FOREIGN PATENT DOCUMENTS

GB 2078556 A * 1/1982
JP 2005087960 A * 4/2005
WO WO 9114509 A1 * 10/1991
WO WO 9817402 A1 * 4/1998

OTHER PUBLICATIONS

Lex-Aire website, publicly available at http://www.lexaire.com/dryaire/index.html as of Mar. 22, 2009. Document submitted herewith was obtained using the Wayback Machine located at http://www.archive.org/web/web.php.

*Primary Examiner* — Steve M Gravini
(74) *Attorney, Agent, or Firm* — The Weintraub Group, P.L.C.

(57) ABSTRACT

A paint drying booth includes a plurality of walls, a ceiling, and an access door for egress and ingress. A turbine generates heated compressed air which is delivered to the interior of the booth via a duct system. The duct is in fluid communication with an air knife having a slit which delivers a stream or sheet of air into the interior of the booth. More than one air knife can be provided, and the orientation of the plurality of air knives are coordinated to provide a flow of heated turbulent air within the booth to accelerate the drying of painted items within the booth. The turbine comprises a multi-stage compressor including a plurality of rotors and stators for compressing air passing therethrough. Optionally a pneumatic spray gun can be provided for painting the items within the booth as well.

4 Claims, 13 Drawing Sheets

(56) References Cited

U.S. PATENT DOCUMENTS

| | | | | |
|---|---|---|---|---|
| 5,935,461 | A * | 8/1999 | Witherspoon et al. | 219/121.59 |
| 6,192,604 | B1 * | 2/2001 | Morrison | 34/666 |
| 6,684,528 | B1 * | 2/2004 | Morrison | 34/666 |
| 2004/0148796 | A1 * | 8/2004 | Morrison | 34/666 |
| 2007/0022625 | A1 * | 2/2007 | DeRegge et al. | 34/275 |
| 2012/0102780 | A1 * | 5/2012 | Bruischat | 34/475 |
| 2012/0260521 | A1 * | 10/2012 | Bunnell et al. | 34/666 |
| 2012/0310140 | A1 * | 12/2012 | Kramer et al. | 604/20 |

* cited by examiner

TURBINE AND AIR KNIFE ASSEMBLY

CROSS-REFERENCE TO RELATED APPLICATION

This application is a continuation-in-part of Application No. PCT/US10/53665, filed Oct. 22, 2010, which claims the benefit of Provisional Application Ser. Nos. 61/254,018, filed Oct. 22, 2009, and 61/357,826, filed Jun. 23, 2010, the disclosures of which are hereby incorporated by reference.

1. FIELD OF THE INVENTION

The present invention pertains to paint spray booths. More particularly, the present invention pertains to the drying of aqueous-based paints in a paint spray booth. Even more particularly, the present invention concerns paint spray booth systems utilizing pressurized air for both spraying and drying of aqueous-based paints.

2. Field of the Invention

As is known to those skilled in the art to which the present invention pertains, the automotive industry is being switched to water-based paints from solvent-based paints because of the volatile organic chemicals (VOCs) in the solvents. The elimination of VOCs for environmental purposes is well documented. However, the utilization of water-based paints creates issues ordinarily not encountered with solvent-based paints.

For example, water-based paints ordinarily require more time for drying than solvent-based paints. Specifically, an entire three-layer application (that is, primer, color coat, and top coat) of solvent-based paint for a small repair job may take 70 to about 180 minutes to dry at an ideal temperature. The same task with a water-based paint requires much more time because the water-based color coat alone might take about 30 to 180 minutes to dry. This problem is exacerbated in high-humidity environments. Because it takes longer to perform the complete paint job and a repair shop is working with limited resources and amount of space, water-based paints are more costly to use because the number of customers which can be serviced is reduced. Thus, there exists a great need for accelerating the drying time of items which have been painted with aqueous-based paints.

SUMMARY OF THE INVENTION

The present invention provides an improved turbo-compressor-driven paint spray booth. The booth, itself, generally comprises an enclosure having a pair of upstanding sidewalls, a rear wall, a front wall, a roof and open interior. An access is provided for both ingress and egress into the booth.

A turbo-compressor delivers heated air into the interior of the booth via a duct system. The duct system is in fluid communication with at least one air knife positioned inside the booth.

The at least one air knife is provided for manipulating and directing the flow of the heated air within the booth. As understood by one having ordinary skill in the art, the air knife comprises a housing having an elongated slit which issues the hot air therefrom into the interior of the booth. Each provided air knife has its respective air slit oriented toward an adjacent corner of the room to effectuate a directed turbulent flow of heated air throughout the interior of the booth.

The turbo-compressor preferably comprises a five-stage turbine for both drying and spraying within the booth. Alternatively, a seven-stage turbine can be used as well.

According to a first embodiment hereof, there is provide a paint booth system comprising:

(a) a booth including a plurality of walls, a ceiling, at least one access door, and an interior defined within the walls and the ceiling of the booth;

(b) a turbine for generating heated compressed air, the turbine including an outlet for expelling the air;

(c) a first duct for delivering the heated compressed air from the outlet of the turbine to the interior of the booth; and (d) a first air knife connected to an end of the first duct located in the interior of the booth, the first air knife being in fluid communication with the outlet of the turbine, the first air knife having an elongated slit for directing a sheet of heated air into the interior of the booth.

According to a second embodiment hereof, there is provided a paint spray booth system comprising:

(a) a booth including a plurality of walls, a ceiling, at least one access door, and an interior defined within the walls and the ceiling of the booth;

(b) a turbine for generating heated compressed air, the turbine including an outlet for expelling the air;

(c) a first duct for delivering the heated compressed air from the outlet of the turbine to the interior of the booth;

(d) a first air knife connected to an end of the first duct located in the interior of the booth, the first air knife being in fluid communication with the outlet of the turbine, the first air knife having an elongated slit for directing a sheet of heated air into the interior of the booth; and (e) an auxiliary duct and a pneumatic spray gun, the auxiliary duct being in fluid communication with the outlet of the turbine and having an end which is connectable with the spray gun to provide compressed air to the spray gun.

For a more complete understanding of the present invention reference is made to the following detailed description and accompanying drawings. In the drawings, like reference characters refer to like parts throughout the several views in which:

DESCRIPTION OF THE PREFERRED EMBODIMENT

Figure 1:
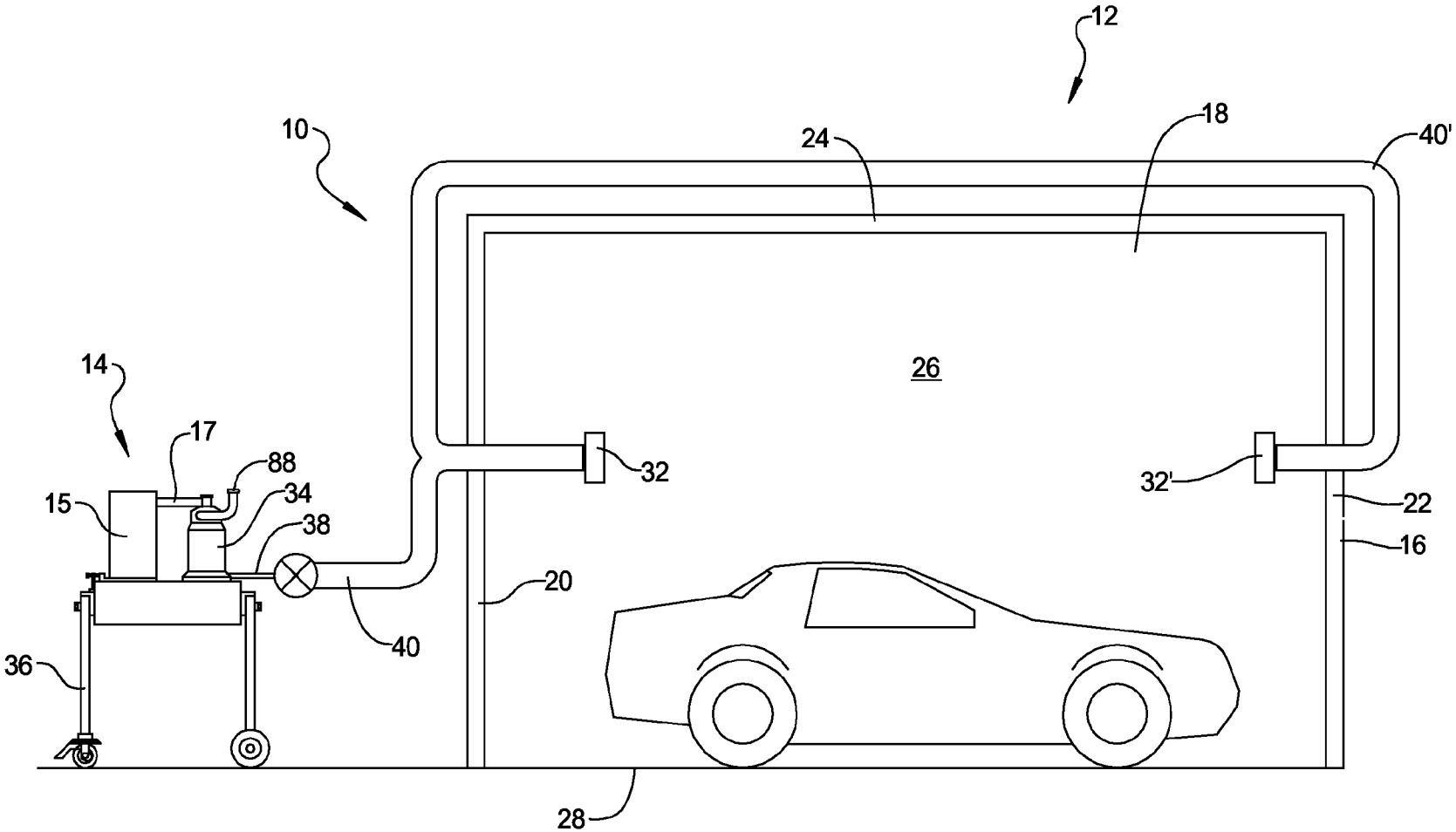
FIG. 1 is a cut-away side elevation view of a first embodiment of a paint spray system in accordance with the present invention.
Figure 2:
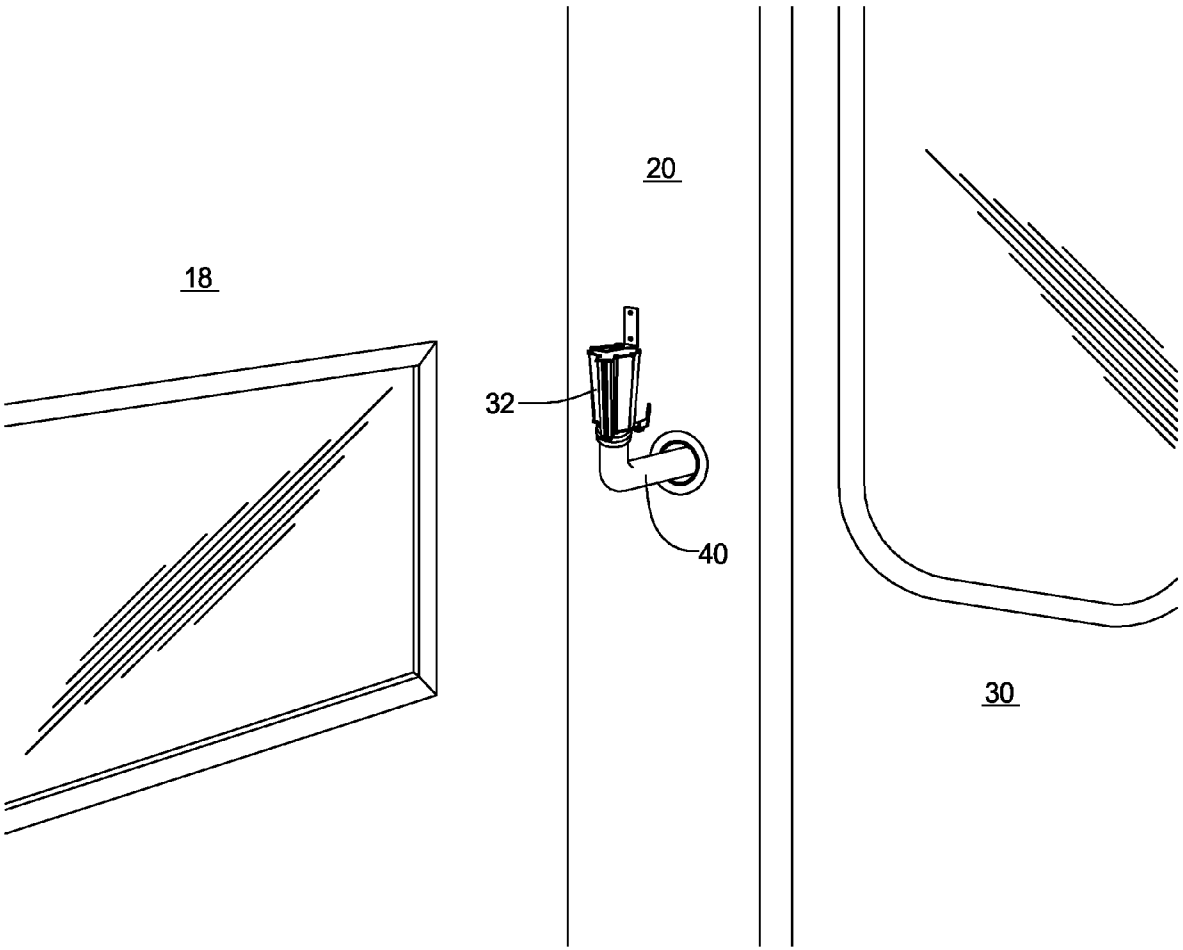
FIG. 2 is a partial perspective view depicting a portion of the interior of a paint spray booth used in the present paint spray system.

Now, and with reference to the drawings, and in particular FIGS. 1-2, there is depicted herein a first embodiment of a paint spray system in accordance with the present invention and generally denoted at 10. The system 10 hereof comprises a paint spray booth 12 and a turbine 14 for generating heated air for introduction into the booth 12.

More particularly, the paint spray booth 12 hereof comprises an enclosure 16 having a pair of upstanding sidewalls 18 (only one of which is shown), a rear wall 20, a front wall 22, a roof 24, and an open interior 26. Typically, a ground surface such as a floor comprises a base or bottom 28 of the booth 12.

An access 30, such as a hinged door or other suitable closure (e.g., a rollable or pivotable garage door) is provided for both ingress and egress into the booth 12. Although not shown in the drawings, the booth 12 may include all of the traditional peripheral equipment typically associated therewith, such as lights, drains, and the like.

As detailed hereinbelow, the booth 12 further comprises at least one air knife 32 for directing the flow of hot air within the booth 12.

The turbine 14, which is more fully described below, includes a gas compressor 34 and is used to deliver heated air to the interior 26. The turbine 14 is preferably stowed atop a wheeled stand 36 for portability. The air issuing from the turbine 14 generally ranges from about 80° F. to about 240° F. above the ambient temperature of the air entering the compressor 34. The turbine 14 is driven by an electric motor 15. Preferably, the electric motor 15 is a three-phase motor to allow for variable speed output. The electric motor 15 rotates the turbine 14 by rotating a drive shaft 90 via any suitable means, such as a drive chain or a drive belt 17.

Generally, and as shown in FIG. 1, the turbine 14 includes a conduit, or outlet 38, which is connected to the compressor 34 and receives the hot compressed air exiting therefrom. The other end of the outlet 38 is detachably mounted to, and in fluid communication with, a first duct 40. The outlet 38 is connected to the first duct 40 by any suitable means, such as by friction, clamping, or the like.

The first duct 40 extends into the booth interior 26 at any convenient location within the booth 12, although it preferably enters through the rear wall 20. The first duct 40 is stationary and delivers heated air into the interior 26 of the spray booth 12 via the at least one air knife 32.

The air knife 32 connects to the first duct 40 via any suitable means. As discussed in further detail below, the air knife 32 has an inlet 42, and the respective end of the first duct 40 attaches to the inlet using hose clamps, friction fittings, or the like.

Optionally a second duct 40' can be provided as well. The second duct 40' is preferably split off from the first duct 40 and extends therefrom. A portion of the hot air passing through the first duct 40 exits into the interior 26 via the air knife 32, and the remaining portion of the hot air passes into and through the second duct 40'. The second duct 40' connects to a second air knife 32' in the same manner as the first duct 40 and the air knife 32. When provided, the second air knife 32' is preferably diametrically opposed to the air knife 32 and is mounted to the front wall 22 at substantially the same height as that of the air knife 32. The first and second air knives 32,32' are positioned to direct the flow of heated air into and throughout the interior 26 in a specific manner described in further detail below.

Figure 3:
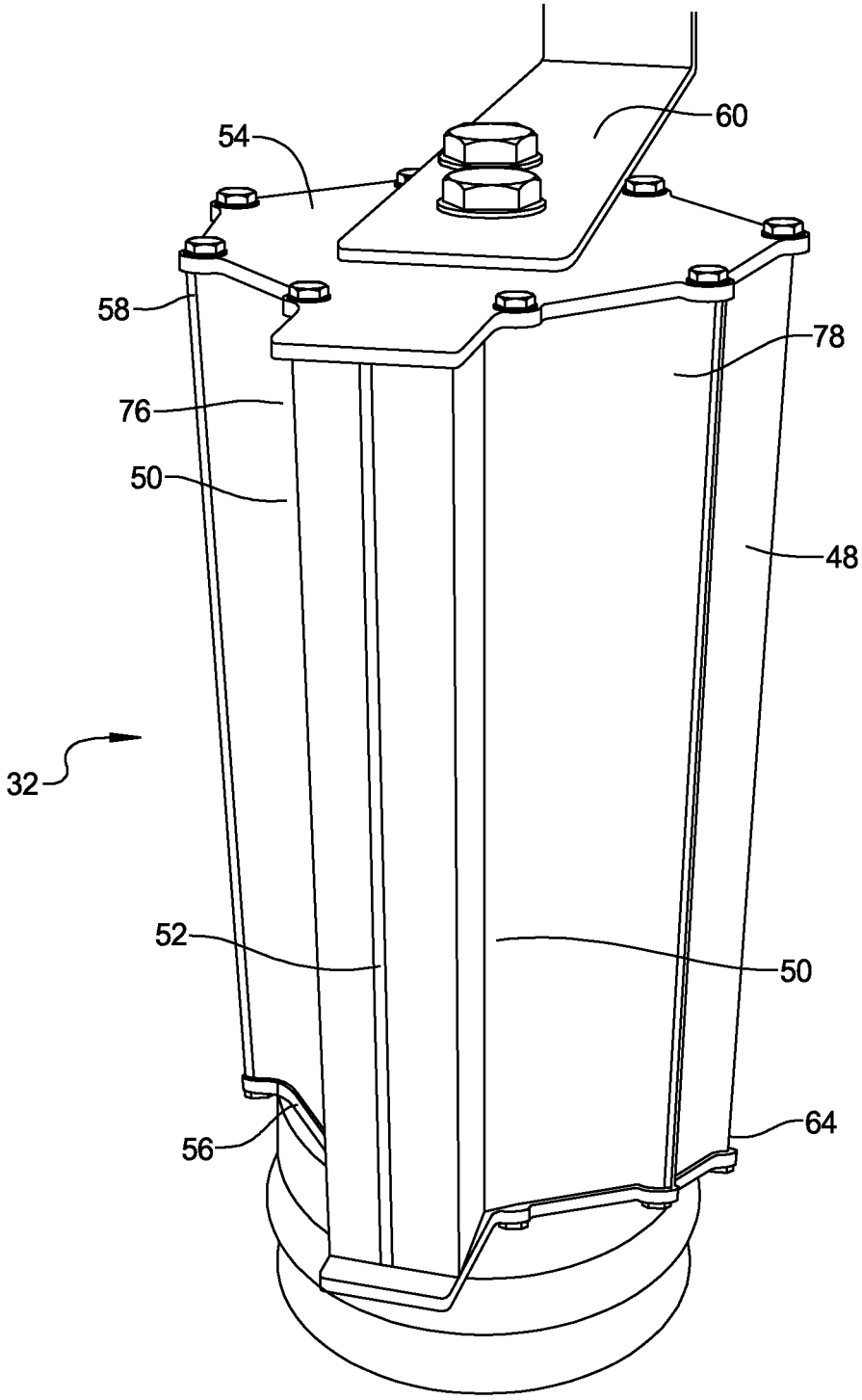
FIG. 3 is a perspective view of an air knife used in the practice of the present invention.
Figure 4:
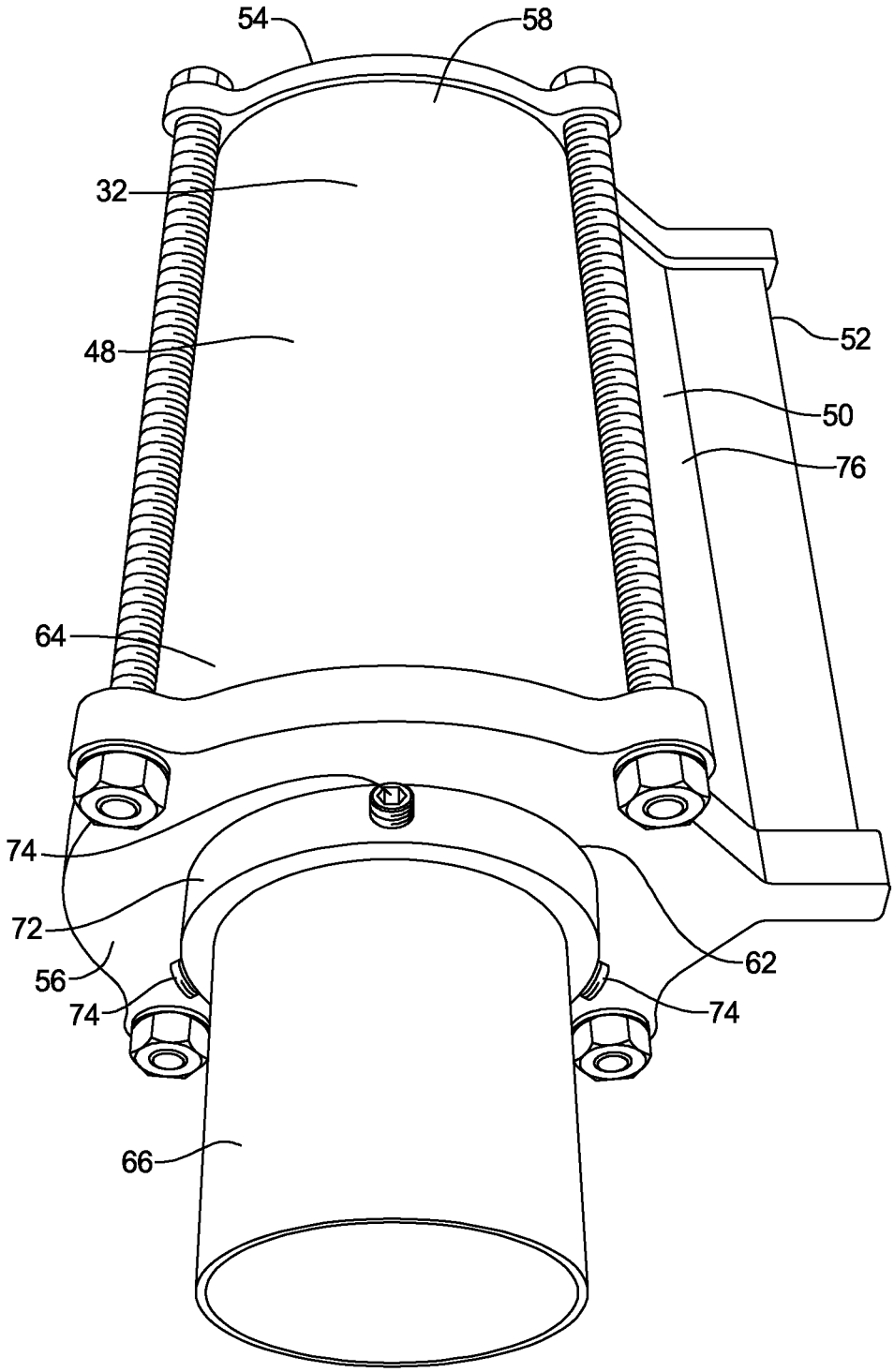
FIG. 4 is a perspective view of the air knife showing the bottom portion thereof.
Figure 5:
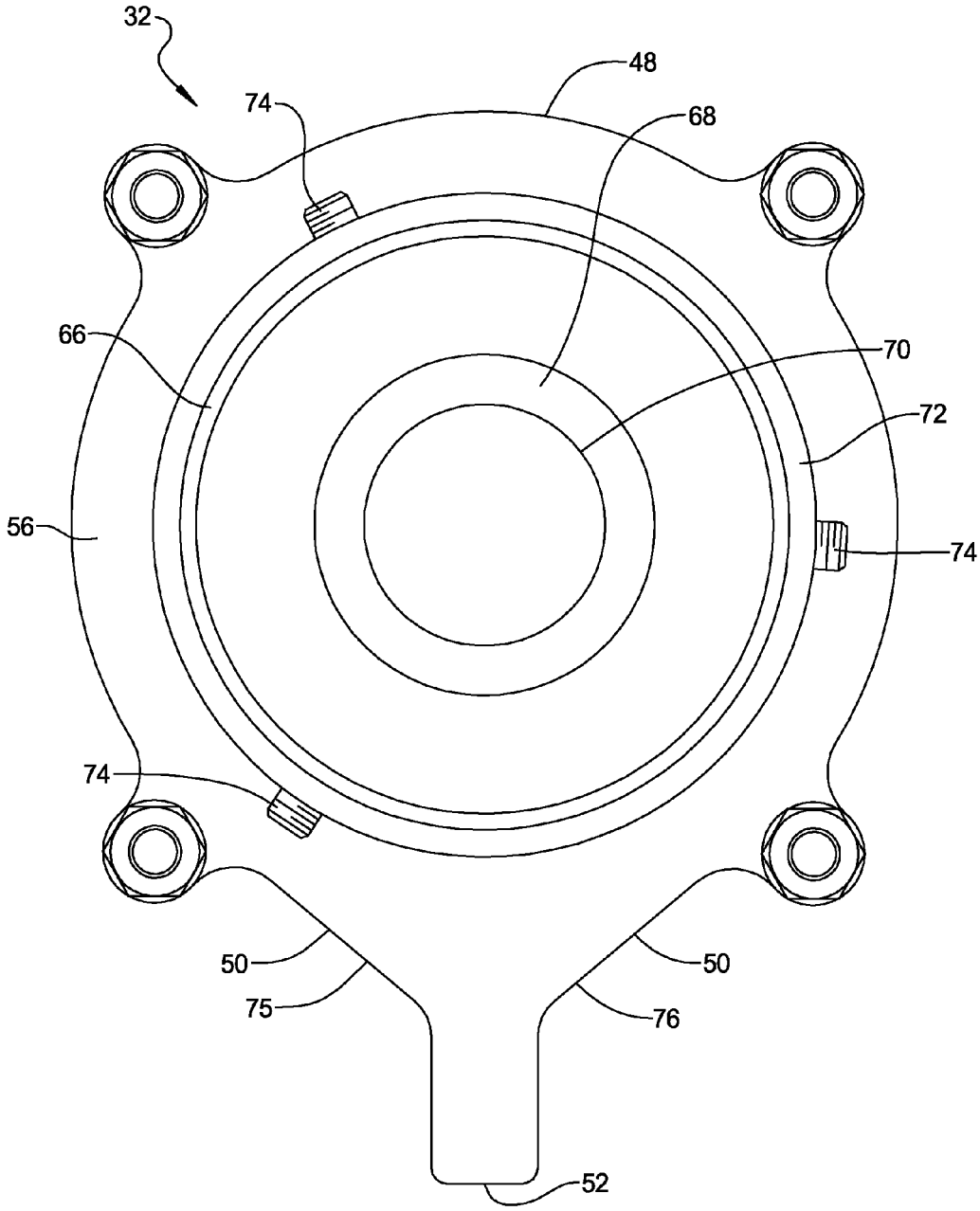
FIG. 5 is a bottom view of the air knife.

Since each air knife 32,32' is identical, for purposes of brevity, only one will be described. As illustrated in FIGS. 3-5, the air knife 32 is mounted over or atop the respective end of the first duct 40 by conventional means, such as clamping with a hose clamp, frictional fit, or the like. Any suitable type of air knife which is well-known to one having ordinary skill in the art can be used. As commonly understood, the air knife 32 is designed to discharge a laminar stream, or sheet, of high temperature pressurized air. The air is directed into the open interior 26 in a manner to create improved air circulation and reduced paint drying time within the paint spray booth 12.

As shown, the air knife 32 is a plenum which comprises a typical "teardrop" design having an elongated generally cylindrical body 48 and a tapered side portion 50. The tapered side portion 50 terminates at an elongated slot, or slit 52. The air knife 32 is closed on each end by a respective top plate 54 and bottom plate 56. The top plate 54 is secured to a first end 58 of the body 48 by conventional means, such as by screws or other suitable means for fastening.

The air knife 32 can be mounted to any of the walls 18, 20, 22 or the ceiling 24 using any suitable means which are well-known to one having ordinary skill in the art. For instance, the air knife 32 can be secured to a support bracket 60 which is mounted within the booth 12.

Although not shown, each of the plates 54 and 56 can be provided with an interior groove which seats the upper and lower edges of the body 48 to provide a secure and nested fit together.

As shown in FIG. 4, the bottom plate 56 includes a central aperture 62 and is coupled to a second end 64 of the body 48 by conventional means. The central aperture 62 can have a diameter sized for connection with the first duct 40.

To facilitate the connection between the central aperture 62 and the first duct 40, a tube 66 can be provided to extend outwardly from the central aperture 62. The tube 66 is a substantially cylindrical member which is detachably secured or otherwise affixed to the first duct 40 at the free end thereof. As shown in FIG. 5, the tube 66 can include a nozzle 68 which extends into the body 48. The nozzle 68 is a substantially cylindrical body which terminates in a tapered reduced diameter portion 70 having a diameter which is preferably about ¾ inch. The outer circumference of the tube 66 is dimensioned to be fit securely within the central aperture 62. The tube 66 is a receptor for the first duct 40, and can be secured to the first duct 40 by any conventional means, such as a hose clamp.

In mounting the tube 66 to the bottom plate 56, a pair of spaced-apart fitting rings 72 can be used. The first, or lower, ring 72 is disposed below the bottom plate 56 and is fixed in position by a set screw 74 or other suitable fastening means.

A second, or upper ring (not shown), is disposed above the bottom plate 56 within the body 48 in a similar fashion and is fixed in the same manner using a set screw or the like. The rings enable the tube 66 to be adjustably positioned within the interior of the air knife 32 and can, thus, be slidably positioned within the body 48 as desired.

The tapered side portion 50 extends laterally outwardly from the axis of the cylindrical body 48 and includes a first side 76, a second side 78, and the air slit 52. The first and second sides 76,78 extend axially outwardly from the elongated cylindrical body 48 and converge toward each other near the air slit 52. The air slit 52 is a narrow gap, or slot, that extends substantially the entire the length of the body 48.

The air knife 32 operates in a manner commonly understood to those having ordinary skill in the art. Air enters the hollow body 48 via the aperture 62 and it is directed toward the air slit 52. As the air moves toward the slit 52 it is compressed due to the converging sides 76 and 78. In accordance with known scientific theories, once the air has passed through the slit 52, the air pressure drastically drops and the air accelerates dramatically. As discussed further below, the acceleration of the air exiting the slit 52 is significantly increased even more so due to the elevated pressure of the air as it enters into the body 48.

In operation, the air issuing from the turbine 14 travels through the outlet 38, into and through the first duct 40, and into the interior of the body 48 of the air knife 32. The air is then forced through the narrow air slit 52 of the tapered portion 50.

The air slit 52 is preferably pointed towards an adjacent corner of the booth 12. Directing the air in this manner creates a vortex motion of high velocity heated air within the paint spray booth 12 that significantly reduces drying time of paint on objects therein.

Figure 6:
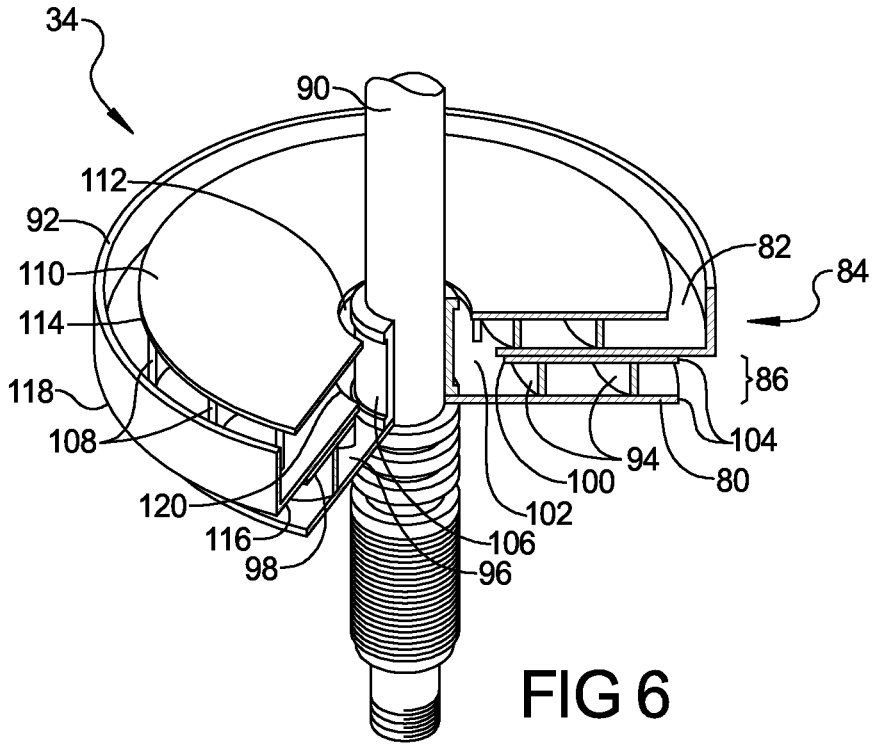
FIG. 6 is a partial cutout perspective view of the drive shaft and rotor-stator arrangement of the compressor showing the rotor of the final bottom-most stage and the stator of an adjacent compression stage.

In practicing the present invention, the compressor 34 of the turbine 14 comprises a multi-stage turbine which delivers air to the paint spray booth 12 at an elevated pressure and temperature. FIG. 6 shows the bottom portion of an exemplary compressor 34 being shown in cut-away. Preferably, the turbine 14 includes at least five stages, although it can have seven stages or more. As described in further detail below, and with the exception of the bottom-most (or final stage), each compression stage 84 includes a rotor 80 and a stator 82. The bottom-most stage 86 does not include a stator 82. In general, air is preferably fed into an air inlet 88 at the top of the compressor 34 and exits through the outlet 38 at the bottom thereof.

With more particularity, and as shown, the compressor 34 includes a centrally disposed drive shaft 90 and a plurality of compression stages 84,84', etc. A drive belt 17 or other suitable means for driving the drive shaft 90 is provided. With the exception of the final stage 86, each stage comprises a rotor 80 and a stator 82 juxtaposed each other.

Each rotor 80 extends radially outwardly from, and is connected to, the drive shaft 90. Thus, each rotor 80 is rotatably driven by the drive shaft 90. Paired with each rotor 80 is a stator 82 which remains stationary as the drive shaft 90 and each rotor 80 rotates. Each stator 82 is secured in position by a ring 92 about its outer circumferential edge. Each rotor 80 and stator 82 comprises a plurality of fins for directing the flow of air therethrough as the drive shaft 90 and rotors 80,80', etc. rotate. The drive shaft 90 is rotatably secured within the turbine 14 by a bearing at both the top and the bottom of the shaft.

As stated above, each stage 84 comprises a rotor 80 and a stator 82. Each rotor 80 and stator 82 comprises a pair of circular plates which sandwich a plurality of spirally-arrayed fins. Each rotor 80 and stator 82 also has an air inlet side, an air outlet side, and a central passage extending therebetween.

Each rotor 80 comprises the plurality of fins 94 which are sandwiched between a pair of rotor plates, the lower plate 96 being secured to the drive shaft 90. The upper plate 98 from the pair of rotor plates has an enlarged inner circumferential edge 100 which provides a gap 102 between the inner edge 100 of the upper plate 98 and the drive shaft 90. As described in detail below, the gap 102 is provided to facilitate the flow of air throughout the compressor 34. As each rotor 80 is rotatably driven by the drive shaft 90, air is drawn down in through the gap 102 and driven radially outwardly by the plurality of fins 94 on the rotor 80. The outer circumferential edges 104 of the upper and lower plates, 98 and 96, respectively, as well as the plurality of fins 94, do not extend outwardly to abut the ring 92.

At least one tubular sleeve 106 is mounted about the drive shaft 90 and positioned between each of the successive rotors 80,80'. The tubular sleeve 106 separates the rotors 80,80', and each sleeve 106 is rotatable with the rotors 80,80' and the drive shaft 90.

Each compression stage 84 also includes the stator 82 which is paired with the rotor 80. Similar to each rotor 80, each stator 82 comprises a pair of circular stator plates having a plurality of fins 108 spirally arrayed outwardly from and around the drive shaft 90. The fins 108 are sandwiched between the pair of stator plates. The stators 82,82' are coaxial with the drive shaft 90. When the compressor 34 includes successive compression stages 84, each compression stage 84 is separated by the ring 92, which is mounted between the stators 82,82' and extends about the outer circumferential edge of the stator 82. The ring 92 provides an outer barrier for entrapping the air within the compressor 34 and forcing the air through the compressor 34 as described in detail below. The upper plate 110 of each stator 82 has an inner circumferential edge 112 which juxtaposes the tubular sleeve 106. Similar to the outer circumferential edge 104 from the pair of rotor plates 96,98, the outer circumferential edge 114 of the upper plate of the stator 82 does not fully extend outwardly to the ring 92. The lower plate 116 from the pair of stator plates has an outer circumferential edge 118 which extends outwardly to, and can be secured with, the ring 92. The inner circumferential edge 120 of the lower plate 116 does not abut against the tubular sleeve 106, but operates in conjunction with the upper plate 98 of the rotor 80 to provide the gap 102. Preferably, the final stage 86 at the bottom of the compressor 34 consists only of a rotor 80.

The rotor 80 in the first stage 84 is separated from the rotor 80' in the second stage 84' by the tubular sleeve 106. The stator 82 in the first stage 84 is separated from the stator 82' in the second stage 84' by the ring 92. Preferably, each rotor 80 and each stator 82 are alternately disposed about the drive shaft 90.

Figure 7:
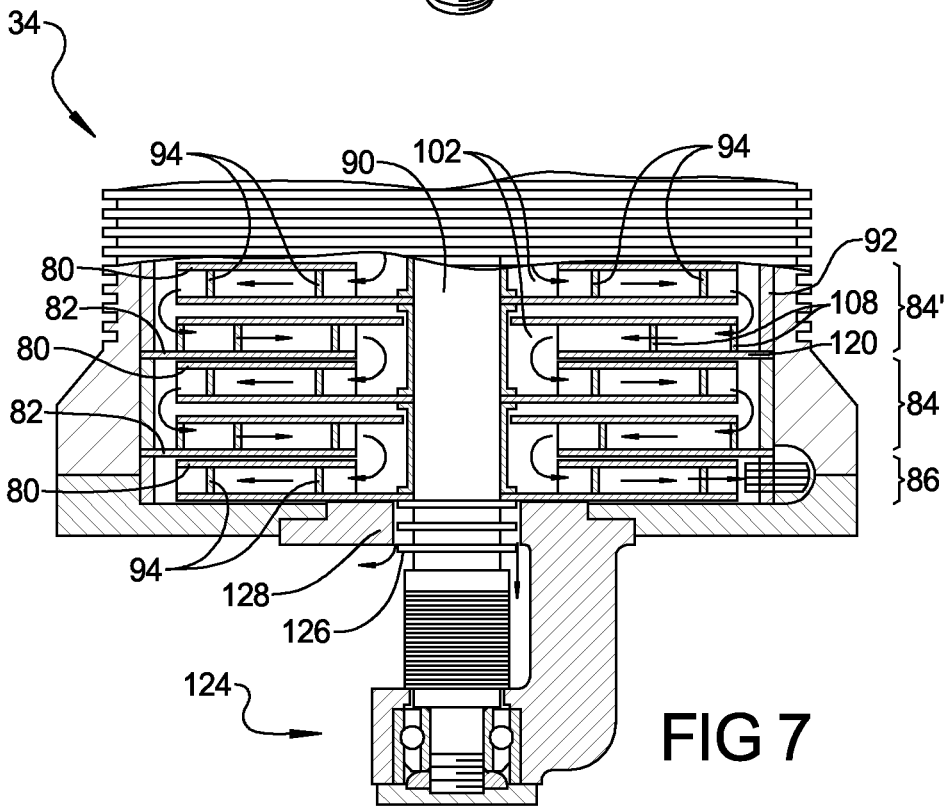
FIG. 7 is a partial sectional view showing the direction of air flow through the final stage and the two preceding compression stages.

In use, the drive shaft 90 rotates the rotors 80,80' while the stators 82,82' remain stationary. FIG. 7 depicts the direction of air flow throughout several successive stages. As the rotors 80,80' rotate, air is drawn in through the gap 102 of the upper plate on the uppermost compression stage. The plurality of fins 94 in the rotor 80 forces the air radially outwardly, and it is then forced downwardly and into the plurality of fins 108 in the adjacent stator 82. The spiral array of the fins 108 in the stator 82 compresses the air as it moves radially inwardly. The air then flows down through the gap 102 past the inner circumferential edge 120 of the lower plate of the stator 82. At that point, the air passes through the gap 102 of the upper plate 98 of the rotor 80 in the next successive stage in the compressor 34, and the air flows through that stage in the same manner as the first. The flow and compression of air throughout each stage operates in the same manner, with the exception of the bottom-most, or final stage 86 which includes a rotor 80 only. The air exits the final stator 82 via the outlet 38 and it is then directed into the duct 40.

The drive shaft 90 is rotatably secured in position by an upper bearing 122 and a lower bearing 124 at their respective ends of the drive shaft 90. The upper and lower bearings 122,124 can be any suitable type of bearing which are well-known to one having ordinary skill in the art. For instance, the bearings can comprise a conventional lubricated ball bearing. As shown in FIG. 7, the lower bearing 124 of the compressor 34 may be air cooled. In such arrangement, the bearing 124 is located at the end of the shaft 90 below the drive belt 17. At least one flange 126 can be provided on the drive shaft 90 to form a substantially air tight barrier with the compressor housing 128 to restrict air losses and prevent damage to the internal rotating parts in the event of a failure of the lower bearing 124. When the lower bearing 124 is air cooled, fans (not shown) can be provided to direct cooling air to the lower bearing 124.

Figure 8:
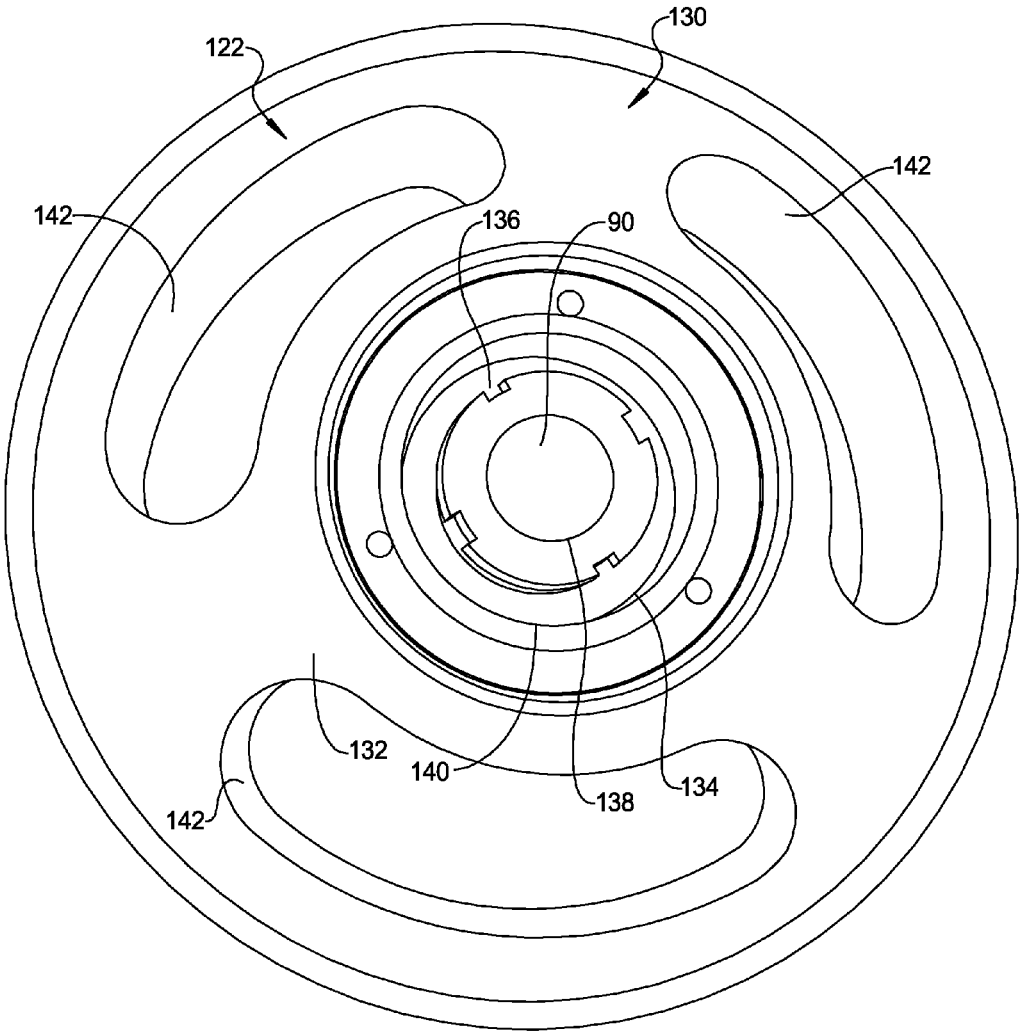
FIG. 8 is an enlarged view showing the bearing assembly at the top of the drive shaft.

As shown in FIG. 8, the upper bearing 122 preferably comprises a bearing assembly 130 including a bearing housing 132 which is secured within the turbine 14 and rotatably entrains the upper end of the drive shaft 90. The bearing housing 132 includes a central circular opening 134. A bearing ring 136 is positioned within the opening 134 and has an inner circumferential edge 138 which is dimensioned to tightly engage the upper end of the drive shaft 90. The bearing ring 136 has an outer circumferential edge 140 which is also dimensioned for tight fitment within the central circular opening 134. Preferably the bearing ring 136 is formed from metal, and even more preferably, it is formed from bronze. The bearing ring 136 prevents fires from occurring due to the high rate of rotation of the drive shaft 90 and the resulting temperatures. A high-temperature lubricant is also preferably provided between the drive shaft 90 and the bearing ring 136. The bearing housing 132 also includes a plurality of intake openings 142 to allow passage of air into the compressor 34.

Compressing the air as it passes through the compressor 34, also, heats the air, raising the air temperature from about 80° to about 240° F. above the ambient temperature of the air entering the compressor 34.

It should be noted that, the type of five-bladed turbine 14 contemplated for use herewith is of the type which is commercially available and sold by Can-Am Engineered Products, Inc.

Figure 9:
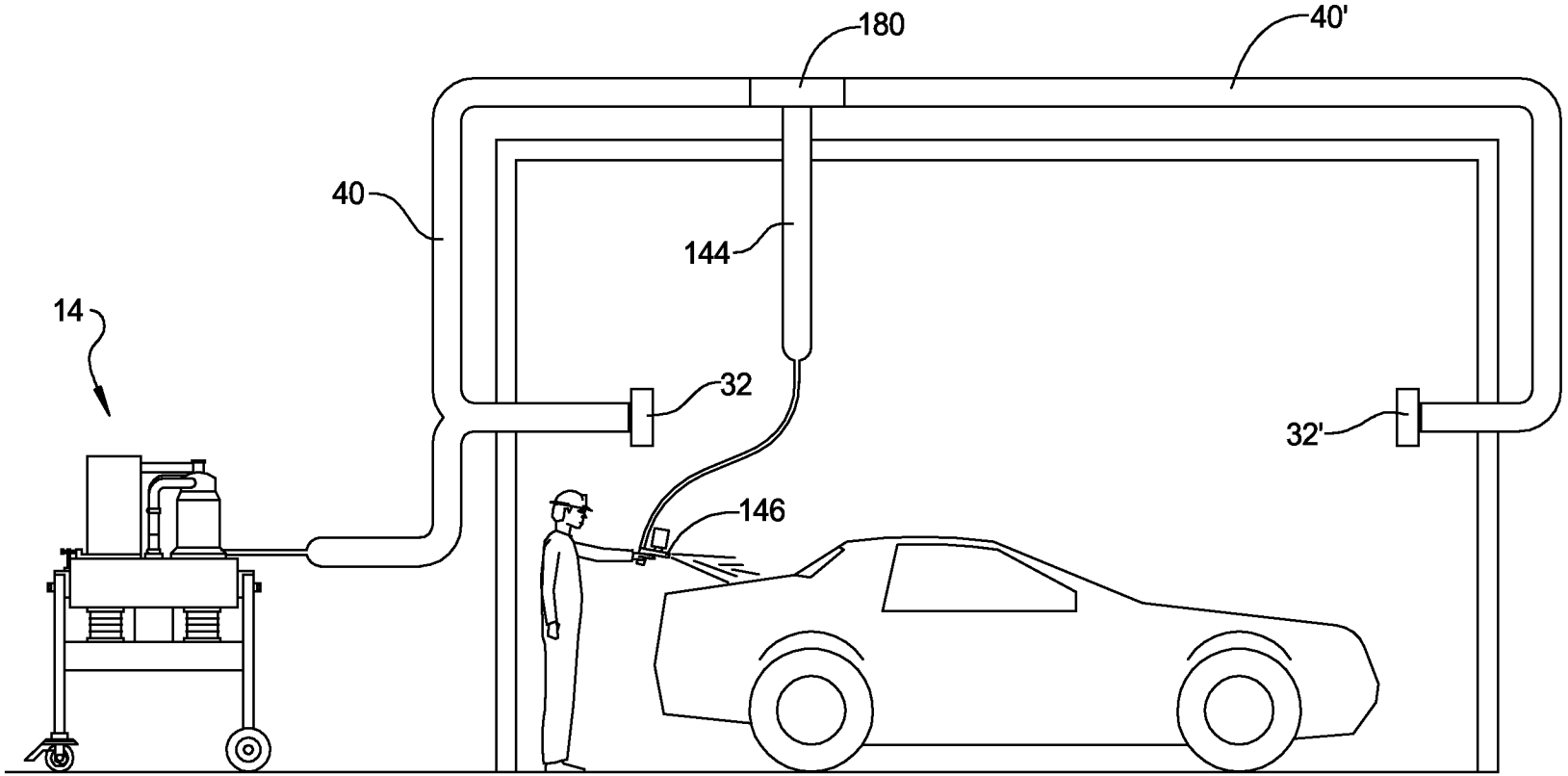
FIG. 9 is a side view of a second embodiment of the present invention showing an auxiliary duct connected to a spray gun for painting items in the booth.

In addition to drying painted items, the turbine 14 may be used to provide compressed air for painting items as well, depending on the type of coating. As shown in FIG. 9, in such instance, an auxiliary duct 144 is connected to a pneumatic sprayer 146, e.g. spray gun, while the other duct(s) 40 continues to provide heated air to the interior through the associated air knife(s) 32.

Where both drying and spraying are desired, regardless of the nature of the coating, and in accordance herewith, it is preferred that a seven-stage turbine 14 having an air cooled bearing 124 be used herein. This type of turbine is as described above in connection with FIGS. 6 and 7, and is more particularly described in U.S. Pat. No. 4,925,368, the disclosure of which is hereby incorporated by reference.

The seven-bladed turbine 14 is, also, commercially available from Can-Am Engineered Products, Inc. and is sold under the trademark Turbo Coat-Air™.

When using such a seven-bladed turbine, and to a lesser degree a five-bladed turbine, noise suppression is important.

To accommodate the flow of air, while at the same time suppressing noise generated by the turbine 14, a noise suppressor (not shown) may be suspended below the housing 128. By diverting some of the air through a motor casing around the lower bearing 124, a further cooling effect is achieved.

Figure 10:
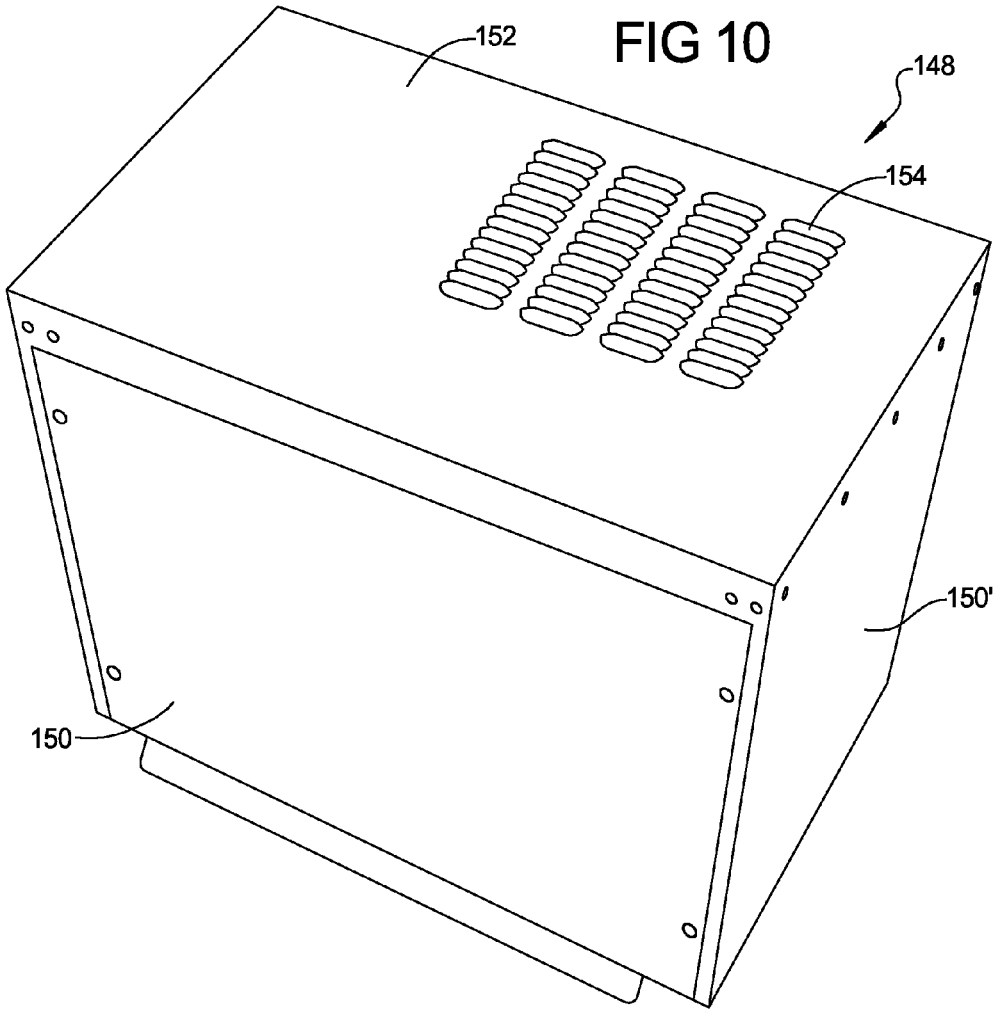
FIG. 10 is a perspective view of an enshrouded turbine used in the practice of the present invention.

As shown in FIG. 10, an enclosure or shroud 148 encloses the turbine 14 and compressor 34 to further effectuate noise suppression. The shroud 148 is fitted atop the stand 36 over the turbine 14. The shroud 148 comprises a plurality of walls 150,150', etc. and a top wall 152. The top wall 152 can include a plurality of louvers or openings 154 to enable ambient air to enter into the interior of the shroud 148 to effectuate cooling.

Although not shown in the drawings, it is also possible to further suppress noise by enshrouding the intake of the compressor with suitable matting, such as foam or the like to further suppress noise.

Figure 11:
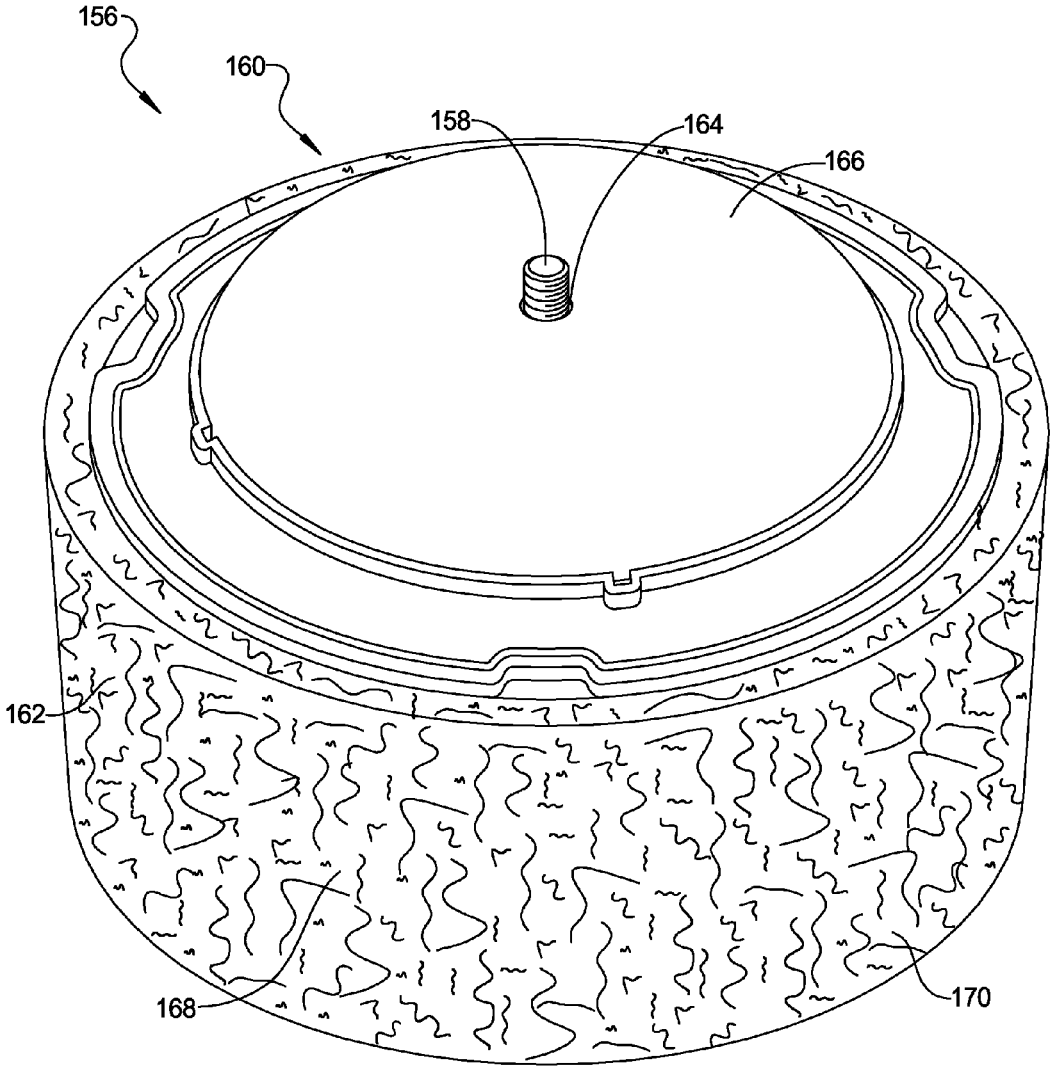
FIG. 11 is a perspective view of the air filter assembly for placement atop the compressor.
Figure 12:
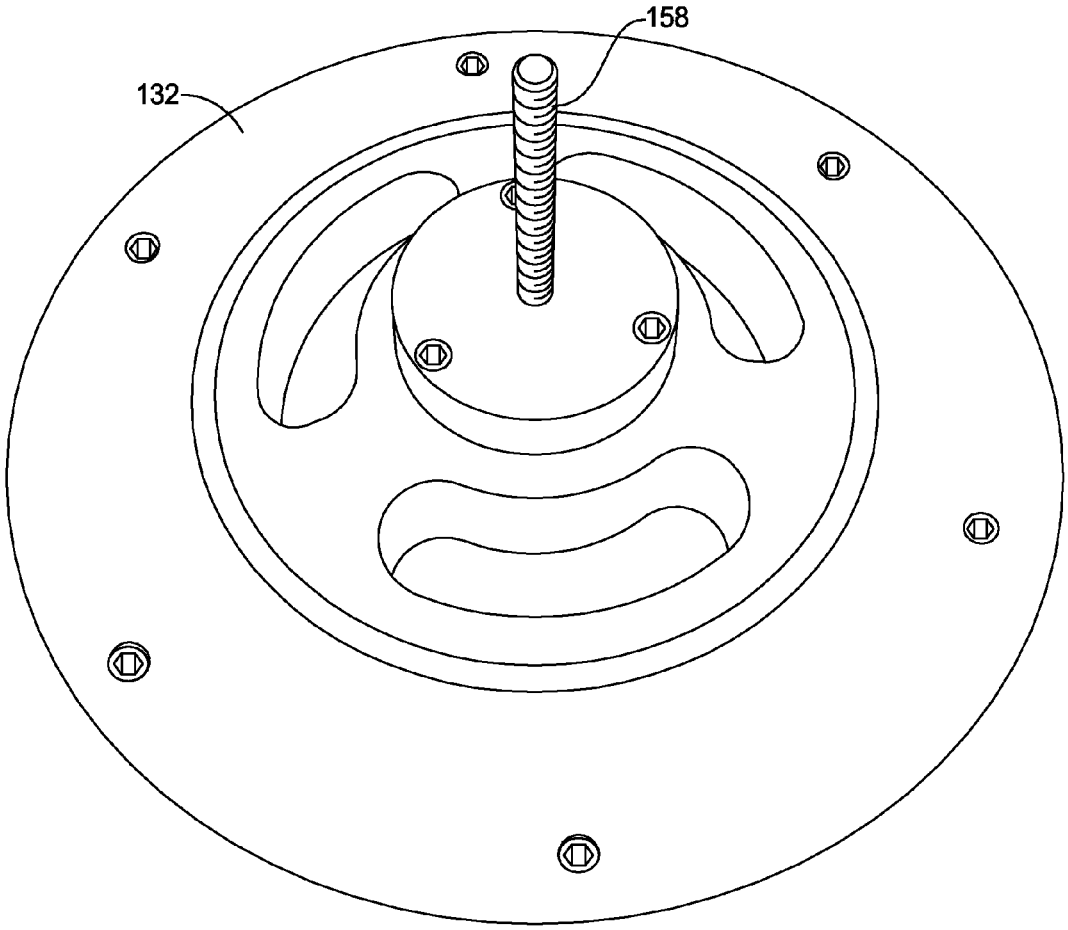
FIG. 12 is a perspective view of the upper bearing housing having a mounting bolt secured thereto.

Referring now to FIG. 11, there is shown an air filter assembly 156 for placement atop the compressor 34. When the air filter assembly 156 is provided, a mounting bolt 158 can be secured atop the bearing housing 132 for mounting the air filter assembly 156 upon, as shown in FIG. 12. The air filter assembly 156 includes a retaining assembly 160 and at least one air filter 162. The air filter 162 is cylindrical and having an open top and bottom. The air filter 162 comprises any suitable air filtering media or material which is well-known to one having ordinary skill in the art, including pleaded filter paper, a sponge, a nonwoven material, and the like.

The retaining assembly 160 is positioned atop the air filter 162 and includes a concentrically located hole 164 for receiving the bolt 158. Any suitable fastener, such as a nut, can be used to threadably secure the retaining assembly 160 over the air filter 162 atop the compressor 34. The retaining assembly 160 can include an air filter media 166 as well to provide additional surface area for the filtering of air.

Optionally, a second air filter 168 can be provided which is concentric with and envelops the first air filter 162.

Optionally, a third air filter 170 is provided which encircles the second air filter 168 and further filters the air entering the compressor 34. The filter media for the third air filter 170 is, preferably, a pleated heavy paper or the like. A mesh retainer (not shown) can be provided to retain the third air filter 170 in place.

Yet another optional air filter (not shown) can be provided as well. Preferably this air filter comprises a batt formed from any suitable material such as cotton, wool, or the like, and provides another filter and noise suppressing layer.

It has been found that by using multiple layers of air filtering and noise suppression materials, noise levels are reduced well beyond the levels required by OSHA regulations.

Figure 13:
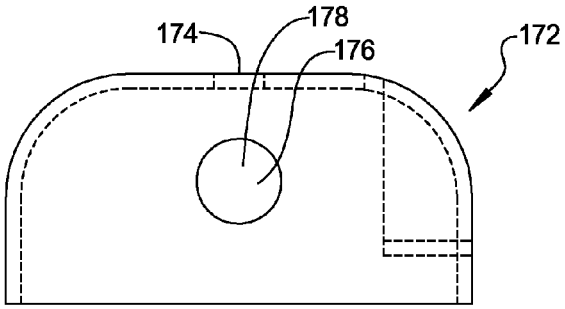
FIG. 13 is a top plan view of a preferred cover for the compressor.

As shown in FIG. 13, there is provided a cover 172 for securement over the compressor 34. The cover 172 fits over and enshrouds the air filter media 166, covering all three layers (when provided). A central aperture 174 is provided in the cover 172 to enable securement to the bolt 158 via a suitable threaded fastener or the like (not shown).

The cover 172 can include at least two or more air intake ports 176 (only one of which is shown) through which ambient air is drawn into the compressor 34. The ports 176 can comprise holes, louvered slots, or any other suitable air intake opening for allowing air to pass into the cover 172. The air is drawn into the compressor 34 and is forced through the filtering media while the noise is suppressed. Optionally, filtering media 178 can be secured over the ports 176 (or any other air intake supplied on the cover) to filter air before entering the compressor 34.

Referring back to FIG. 9, and in a second embodiment hereof where both spraying and drying are desired, a damper, or valve 180, is interposed the duct 40 and connects to the auxiliary duct 144 which is connected to the one or more paint spray guns 146. The spray gun 146 can comprise any suitable type of pneumatic spray gun. Where more than one gun is used, each spray gun is connected to its own duct for connection to the valve 180. When the valve 180 is fully open, air flows through the duct 40' to the air knife 32' without air flow through the auxiliary duct 144. When the valve 180 is fully closed, air flows through the auxiliary duct 144 to the gun(s) 146 to enable spraying of paint. Although not critical to the practice of the present invention, the guns themselves may be either automatic or manual.

In practicing the present invention it has been observed that air can flow out of the air knife 32 at a rate of upwards of 1100 fpm when measured at about 12 feet downstream from the air knife 32. The temperature of the air issuing from the air knives 32,32', etc. ranges from about 80° F. to 180° F. or more above the temperature of the air entering the compressor 34 and can dry an automotive part in about 120 to about 300 seconds.

Figure 14A:
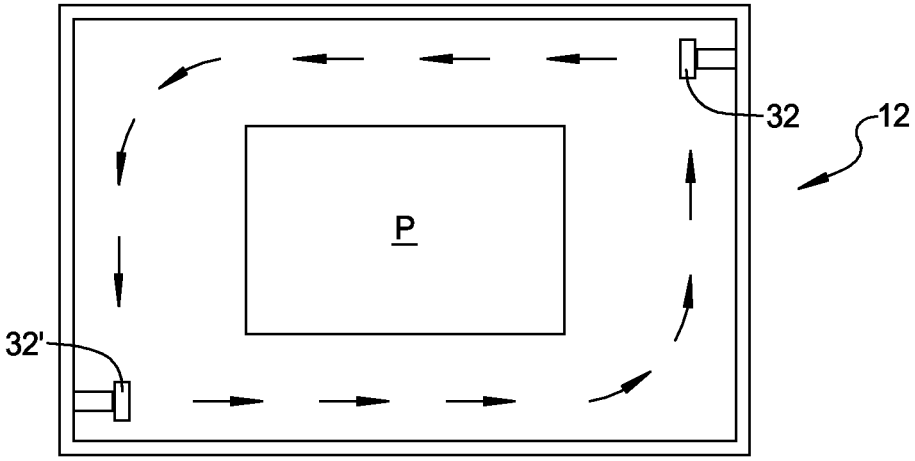
FIGS. 14A-C are overhead views of the interior of the booth showing exemplary arrangements and air flow patterns for various air knife configurations.
Figure 14B:
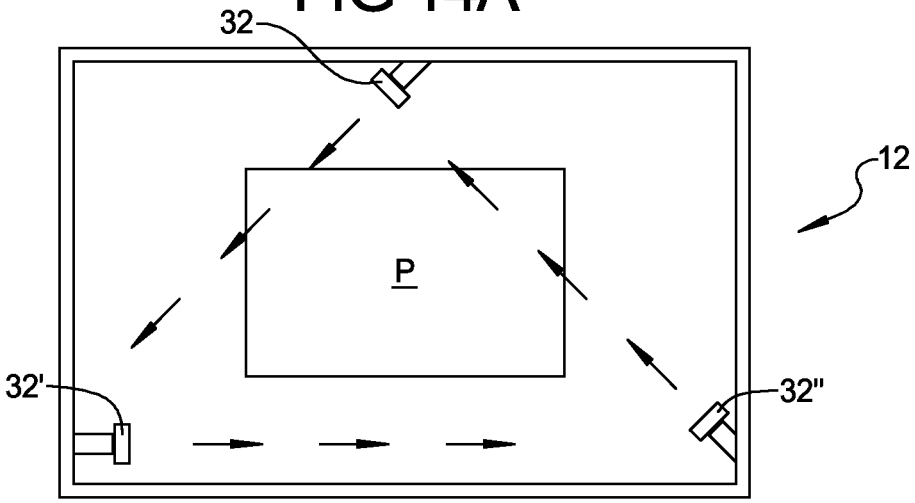
Figure 14C:
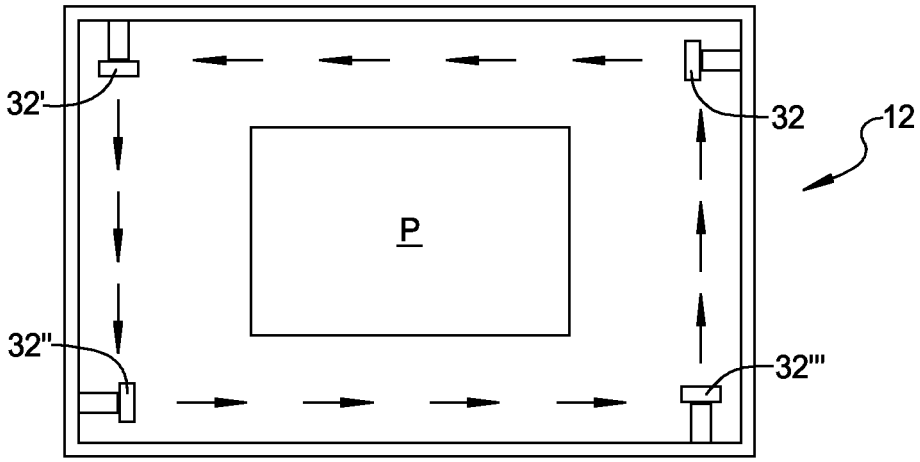
Figure 15:
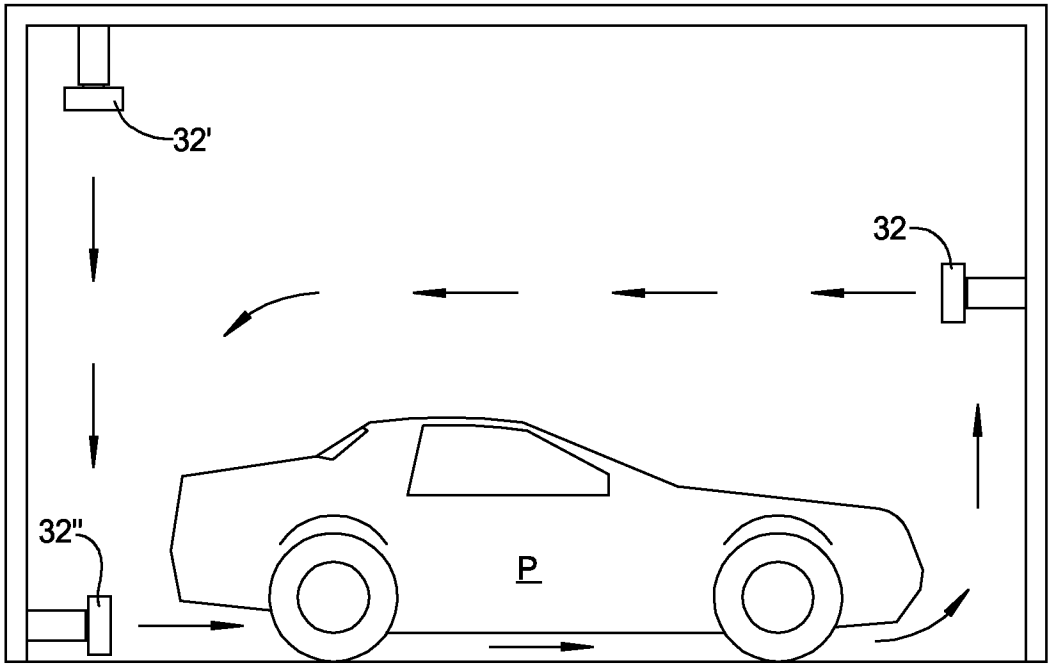
FIG. 15 shows yet another exemplary arrangement and air flow pattern for an air knife configuration.

In order to accelerate the drying time of painted items P inside the booth 12, the air knives 32,32', etc. should be oriented in a coordinated manner to generate a turbulent flow of air throughout the interior 26 of the booth 12. FIG. 14A-C show various air knife configurations and air flow vectors to demonstrate examples of arranging the air knives 32,32', etc. to create coordinated turbulent air flow within the booth 12. In the examples shown in FIG. 14A-C, a range of 2-4 air knives 32,32', etc. are used to create a counterclockwise direction (viewed from atop) of airflow within the booth 12. One having ordinary skill in the art will appreciate that these arrangements are only representative of that which is contemplated herein, and that any suitable number or arrangement of air knives 32,32', etc. can be used. For instance, the air knives 32,32', etc. could also be arranged to direct air flow over and under the painted item P (as shown in FIG. 15) if it is determined that this arrangement produces favorable results.

After the part is dried, which can be sensed through suitable sensors (not shown), such as thermocouples or the like, heated air is then exhausted through the booth by opening a standard exhaust damper.

It should be noted that both the five-bladed and the seven-bladed turbines generate sufficient heated air at a sufficient velocity to enable an additional paint spray booth to be operably connected thereto. Thus, a pair of ducts would extend from a central conduit, such as the outlet, with one duct going to a first booth and a second duct extending to a second booth and, then, a similar arrangement, as described above would be provided to the second booth.

It should be noted, also, that the air knives, themselves, need not be used. Drying air can be introduced in to the interior of the booth directly from the end of the duct.

It is also to be understood that the present invention can be used to accelerate the drying time of solvent-based coatings or paints as well.

It is to be appreciated from the preceding that there has been described herein a paint spray booth assembly which expedites the drying of automotive components when spray painted with aqueous based paints.

What is claimed is:

1. A turbine for use in a spray system for coating an article of manufacture, the turbine comprising:

(a) an air inlet, an air outlet, a cover, and a compressor, the compressor including:

(1) at least four compression stages, a final stage, and a rotatable drive shaft, each compression stage including a rotor and a stator juxtaposed each other, and the final stage including a stationary final stator;

(2) each of the rotors, stators, and the final stator are substantially circular and planar and include an upper plate, a lower plate, and a plurality of fins disposed therebetween, each rotor being connected to and rotatably driven by the drive shaft, and each stator being stationary;

(3) the drive shaft being rotatably secured in position by an upper and a lower bearing assembly, the upper and lower bearing assemblies being located at respective ends of the drive shaft, the upper bearing assembly including a bronze bearing ring which tightly engages the drive shaft; and (b) the cover being secured atop the turbine and over the air inlet, the cover including a plurality of air intake ports and a filter media positioned over the air intake ports to filter exterior air before the air enters the compressor via the air inlet.

2. The turbine of claim 1 further comprising:

(a) a first duct for delivering heated compressed air from the outlet of the turbine to the article of manufacture; and (b) an auxiliary duct and a pneumatic spray gun, the auxiliary duct being in fluid communication with the outlet of the turbine and having an end which is connectable with the spray gun to provide compressed air to the spray gun.

3. An air knife which is connectable to an air supply source, the air knife comprising:

(a) an air drying supply source;

(b) an elongated plenum housing having a cylindrical surface on a first side and a pair of tapered walls on a second side, the housing having a substantially teardrop-shaped cross-section and an open top end and an open bottom end, the tapered walls extending from the cylindrical surface and converging toward each other, the tapered walls terminating in an open slit for expelling air therefrom;

(c) a pair of substantially planar top and bottom plates for attachment to the respective open ends of the housing, the bottom plate including an opening for receiving air from the air supply source, each of the plates including a plurality of aligned holes for receiving a respective elongated fastener which extends therethrough to secure the top plate, housing, and bottom plate together; and (d) wherein the air supply source delivers air into the housing via the opening in the bottom plate, the air being pressurized as it moves from the first side toward the second side along the tapered walls, and the air is then expelled through the slit at an elevated velocity.

4. The air knife of claim 3 wherein the opening in the bottom plate is substantially circular and has a diameter less than that of the plenum.

* * * * *